United States Patent [19]

Carp

[11] 3,963,102

[45] June 15, 1976

[54] COMBINATION CARRY-ON LUGGAGE BAG WITH TOTE BAG AND CLUTCH BAG

[75] Inventor: Bess Carp, Detroit, Mich.

[73] Assignee: Joseph Carp, Detroit, Mich. ; a part interest

[22] Filed: June 17, 1974

[21] Appl. No.: 479,783

[52] U.S. Cl. ..... 190/51; 150/28 R; 150/30; 190/48; 190/41 Z

[51] Int. Cl.[2] ..... A45C 3/00; A45C 13/30

[58] Field of Search ..... 150/28 R, 30, 29, 52 E; 190/48, 51, 52, 42, 41 R, 41 C, 41 Z

[56] References Cited

UNITED STATES PATENTS

| | | | |
|---|---|---|---|
| 2,131,583 | 9/1938 | Crotty et al. | 190/52 |
| 2,164,493 | 7/1939 | Branen | 190/52 |
| 2,540,165 | 2/1951 | Fiel | 190/52 |
| 2,577,670 | 12/1951 | Adams | 190/52 |
| 2,612,199 | 9/1952 | Schocket | 150/30 |
| 2,772,713 | 12/1956 | Koret | 150/28 R |
| 2,988,125 | 6/1961 | Reynolds | 150/28 R |
| 3,194,291 | 7/1965 | Oakes | 150/28 R |
| 3,292,747 | 12/1960 | Dawson | 190/51 |
| 3,326,258 | 6/1967 | Stucker | 150/40 |
| 3,335,775 | 8/1967 | Adams | 150/30 |
| 3,454,068 | 7/1969 | Goldstein et al. | 150/30 |
| 3,543,825 | 12/1970 | Dobbs | 150/35 |

FOREIGN PATENTS OR APPLICATIONS

| | | | |
|---|---|---|---|
| 1,150,881 | 1/1958 | France | 150/28 R |

*Primary Examiner*—William Price
*Assistant Examiner*—Bruce H. Bernstein
*Attorney, Agent, or Firm*—Cullen, Settle, Sloman & Cantor

[57] ABSTRACT

A carry-on luggage bag comprises a housing of flexible material including side, end and bottom walls with top closure flaps interconnected by a zipper. An elongated liner of U shape is mounted upon and spans the side walls, with the bottom wall of the liner spaced from the housing bottom wall to define an auxiliary storage chamber. One side wall is cut away adjacent said auxiliary chamber defining a side flap closed by a zipper. An upright divider is mounted upon the liner bottom wall defining a first storage chamber, adapted to receive, store and enclose a tote bag.

Said tote bag includes a housing of flexible material having side, end and bottom walls, top closure flaps and a zipper interconnecting said flaps. An elongated liner of U shape is mounted upon and spans the tote bag side walls, with the bottom of the liner spaced from the tote bag bottom wall to define an auxiliary storage chamber. One side wall of the tote bag is longitudinally slit adjacent the latter storage chamber, closed by a zipper. An umbrella storage tube is suspended within the tote bag auxiliary chamber. One tote bag end wall has a slit portion, with a zipper closure. An upright divider is mounted upon the tote bag liner bottom wall, defining a storage chamber adapted to receive and store and enclose an article storage clutch bag.

Said clutch bag includes a housing of flexible material having side, end and bottom walls, top closure flaps and a zipper interconncting the flaps. An upright divider is provided upon the bottom wall of said clutch bag. A first series of article storage pockets is arranged upon the inner surface of the clutch bag one side wall. A second series of article storage pockets is arranged upon the inner surface of the clutch bag other side wall. Third and fourth series of article storage pockets are provided upon opposite sides of the latter divider.

11 Claims, 13 Drawing Figures

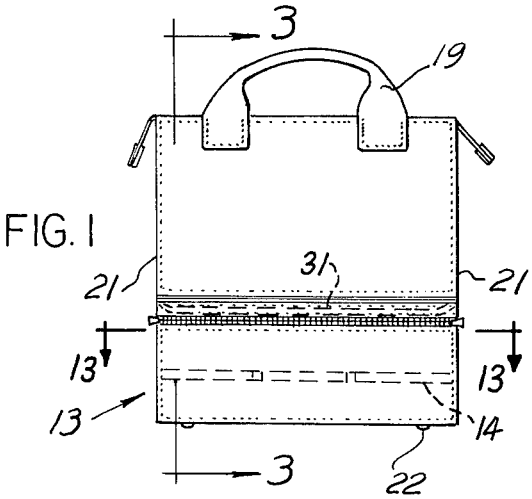
FIG. 1
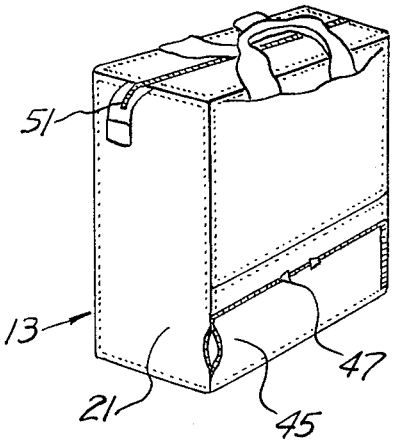
FIG. 2
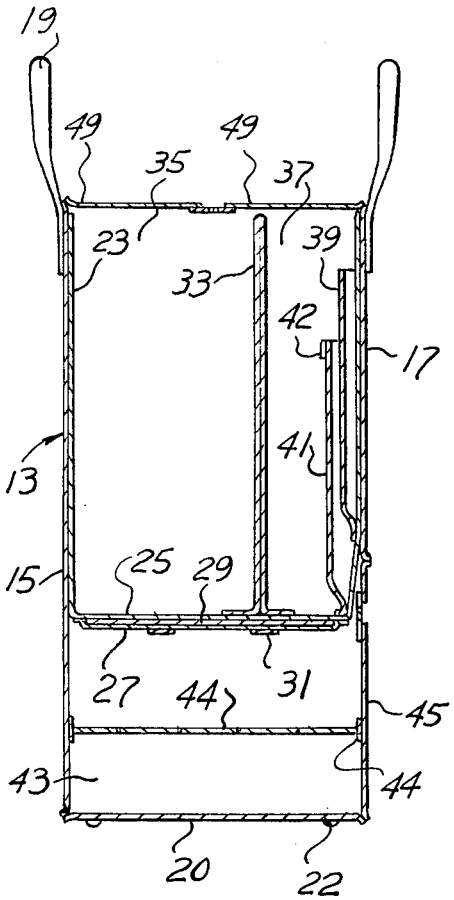
FIG. 3
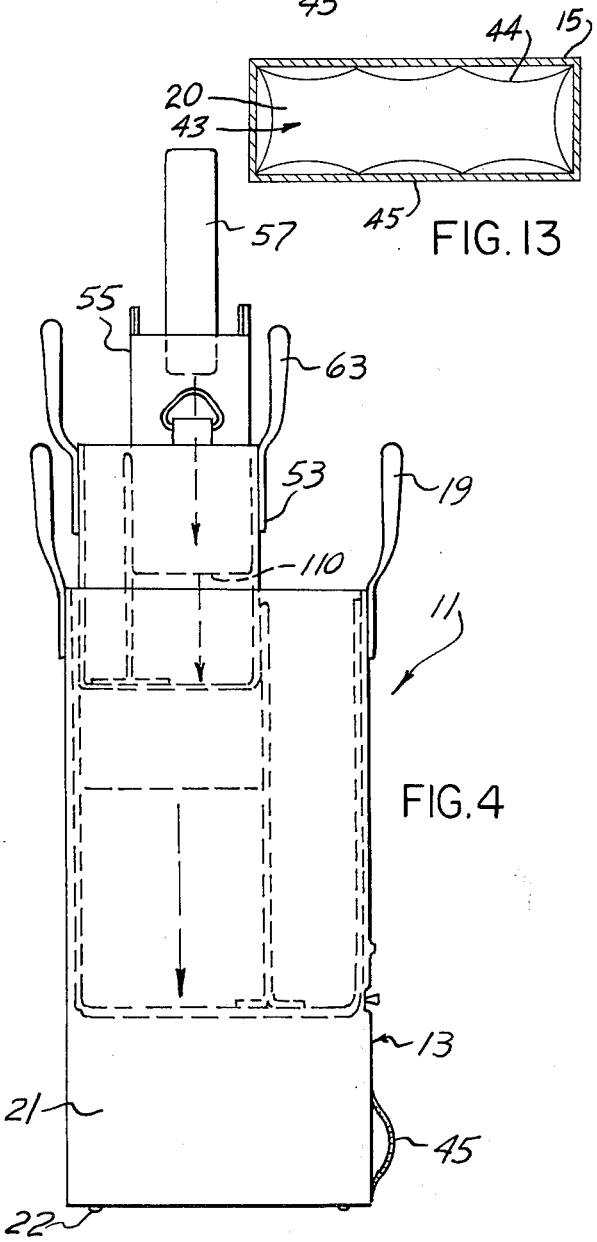
FIG. 13
FIG. 4

COMBINATION CARRY-ON LUGGAGE BAG WITH TOTE BAG AND CLUTCH BAG

BACKGROUND OF THE INVENTION

Heretofore, various types of compartmented travel bags with extra pockets and zippers have been employed, particularly useful to travelers. The difficulty with present tote bags, such as used by travelers, is that the tote bag itself lacks sufficient capacity for the carrying on to a plane, for example, of other useful articles for the traveler's convenience. A further difficulty is that when valuables such as tickets, money, checks and the like are stored within the tote bag, upon arrival at a destination, they must be removed from the tote bag and placed into a purse or the like. They cannot be left in a hotel room.

It is a primary object of the present invention to provide a composite carry-on luggage bag which carries therein a tote bag which carries therein a clutch bag. There is provided within one piece of carry-on luggage a composite assembly of carry-on bag, tote bag and clutch bag wherein all of the valuables are normally carried within the clutch bag. Thus, upon arrival at a destination, the clutch bag can be removed from the tote bag and can accompany the traveler when leaving the hotel room without transferring the valuables.

It is another object to provide an improved carry-on luggage bag which is provided with multiple storage compartments and includes a compartment for storing a tote bag.

It is still another object to provide an improved tote bag construction which includes multiple compartments including a compartment for storing a clutch bag.

It is another object to provide an improved tote bag and clutch bag construction wherein a plurality of very useful storage chambers and compartments are provided, which are easily accessible which provide multiple storage areas for the series of well known articles employed by any traveler and conveniently available to the traveler. The compartments within the clutch bag and tote bag are so arranged that the more valuable of articles are stored within the clutch bag which is removably stored within the tote bag, both being removably stored within the carry-on bag.

These and other objects will be seen from the following specification and claims in conjunction with the appended drawings.

THE DRAWINGS

FIG. 1 is a front elevational view of the present carry-on luggage bag.

FIG. 2 is a front perspective view thereof.

FIG. 3 is a vertical section taken in the direction of arrows 3—3 of FIG. 1, on an increased scale.

FIG. 4 is an end elevational exploded view of the present carry-on luggage bag with the tote bag and clutch bag partly removed.

Figure 6:
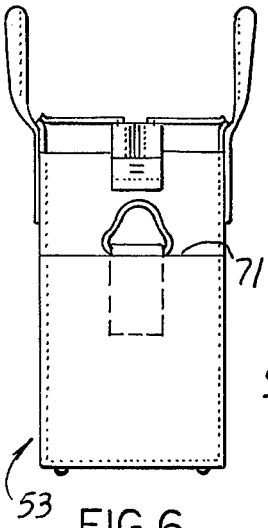
FIG. 6 is a left end elevational view thereof.
Figure 5:
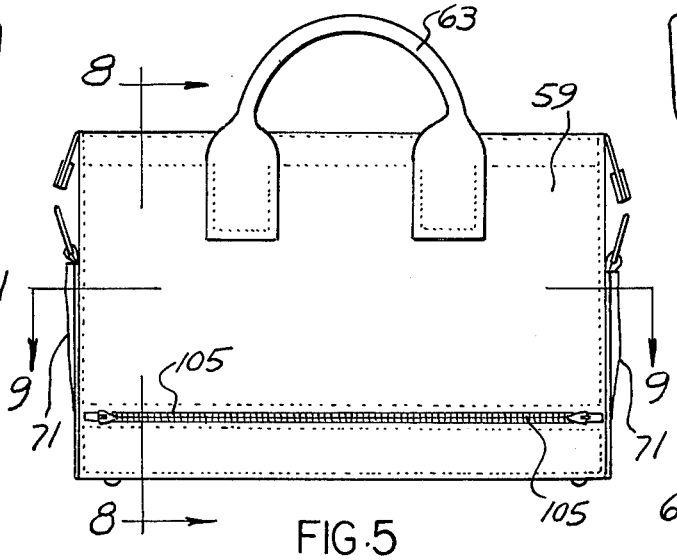
FIG. 5 is a front elevational view of the present tote bag on an increased scale with respect to FIG. 4.

It will be understood that the above drawings illustrate merely a preferred embodiment of the invention, and that other embodiments are contemplated within the scope of the claims hereafter set forth.

DETAILED DESCRIPTION OF THE INVENTION

Referring to the drawings, the present combination carry-on bag with tote and clutch is shown in use condition, FIGS. 1 and 2 and in exploded view and on an increased scale in FIG. 4. The carry-on bag 13 includes side walls 15 and 17, bottom wall 20, handles 19 and end walls 21.

U-shaped liner 23 is mounted upon and spans the side walls of the carry-on bag 13 as shown in FIG. 3 with its bottom wall 25 normally spaced above bottom wall 20 of the carry-on bag defining auxiliary storage chamber 43. The bottom wall of the liner is laminated to include support strip 27 and between said bottom wall and support strip there is positioned an elongated cardboard stiffening liner 29.

Within the chamber 43 and arranged upon the undersurface of the wall 27 are a pair of parallel spaced elastic straps 31 anchored at their respective ends to the undersurface of support 27 at its ends. These straps when stretched downwardly provide a storage compartment below the liner within which certain articles may be stored such as a shirt or pajamas.

The upright divider 33 is mounted upon liner bottom wall 25, suitably secured thereto and extends towards the respective flaps 49. These flaps at their inner margins are interconnected by zipper 51. The divider 33 provides upon one side thereof the tote bag chamber 35 and upon its opposite side an additional storage chamber 37.

A pair of elongated pockets 39 and 41 are arranged upon the interior surface of the front wall 17 within chamber 37. The outer pocket 41 is made of soft nylon-type of fabric and has along its top margin an elastic 42 to facilitate holding articles such as shoes or slippers.

The front wall 17 of the carry-on bag at its lower portion and adjacent the storage compartment 43 is slit to define the flexible flap 45, FIG. 2. This is normally secured with respect to said front wall by the double zipper 47 for easy access into said auxiliary chamber.

Mounted upon the interior walls of said chamber intermediate its height is an elongated strip 44 secured at a series of spaced points to define a series of storage pockets. In addition, miscellaneous articles as desired may be stored within the auxiliary chamber 43.

Figure 12:
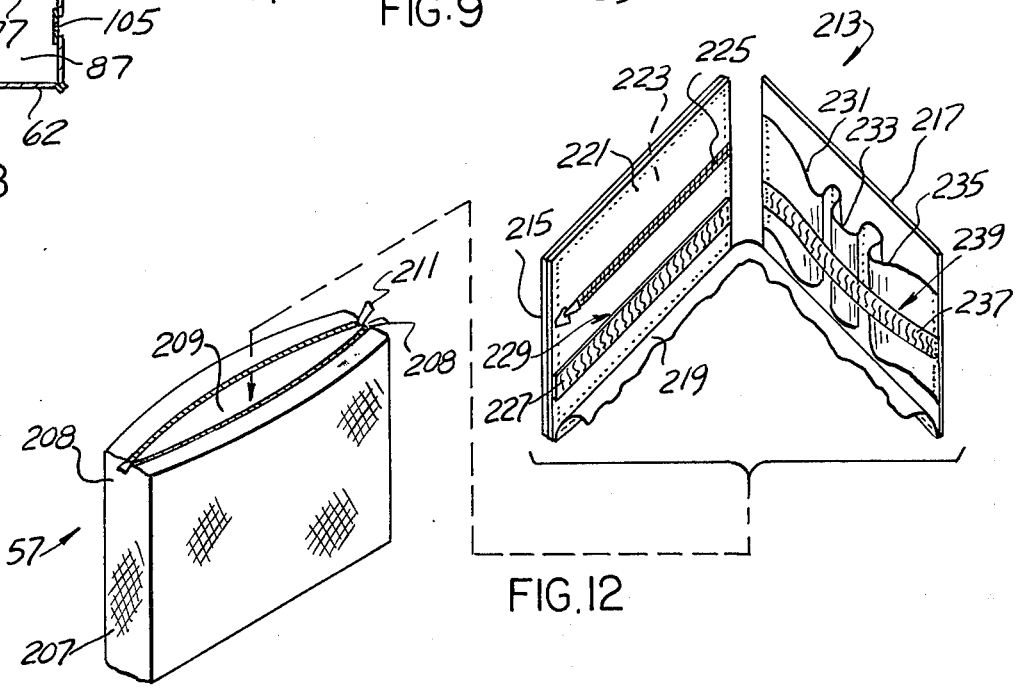
FIG. 12 is a perspective partly broken away exploded view of the present cocoon or auxiliary storage purse.

The tote bag assembly 53 is normally stored and enclosed within chamber 35 of carry-on bag 13 as shown in FIGS. 3 and 4. The clutch bag 55 is normally stored within a suitable compartment within the tote bag 53 shown in exploded view, FIG. 4. An alternately usable cocoon 57, which corresponds to a purse, may be selectively stored within the clutch bag 55 or within tote bag 53 as desired. Its detail and construction is shown in FIG. 12.

TOTE BAG

Referring to FIGS. 5, 6, 7, 8 and 9, the present tote bag 53 includes side walls 59, end walls 61, bottom wall 62 and a pair of handles 63. Across the top of the tote bag are a pair of oppositely arranged hinged top flaps 65 which are interconnected by a conventional zipper 67 for easy access.

Figure 7:
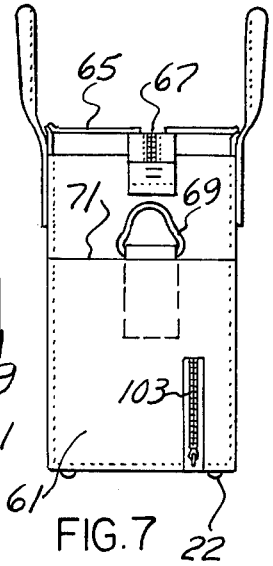
FIG. 7 is a right end elevational view thereof.
Figure 8:
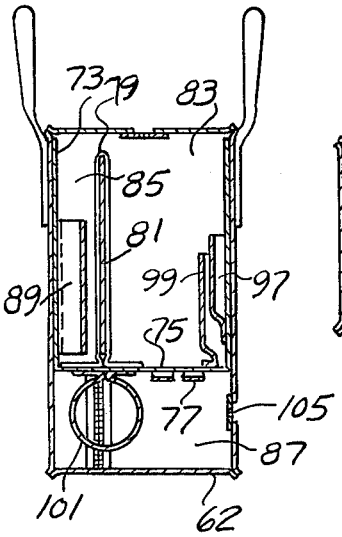
FIG. 8 is a vertical section taken in the direction of arrows 8—8 of FIG. 5.

A pair of rings 69 are arranged at opposite ends of the tote bag and secured to the end walls thereof as best shown in FIGS. 6 and 7. These are adapted to selectively receive the shoulder strap 115, FIG. 10. End pockets 71 are arranged upon the exterior of end walls 61.

U-shaped liner 73 is secured along the inner surface of the sides 59 and includes bottom wall 75 spaced above bottom wall 62 to define auxiliary storage chamber 87. A pair of parallel spaced straps 77 are arranged within chamber 87 below wall 75 with their ends secured thereto to provide a storage pocket directly below the liner bottom wall.

Figure 10:
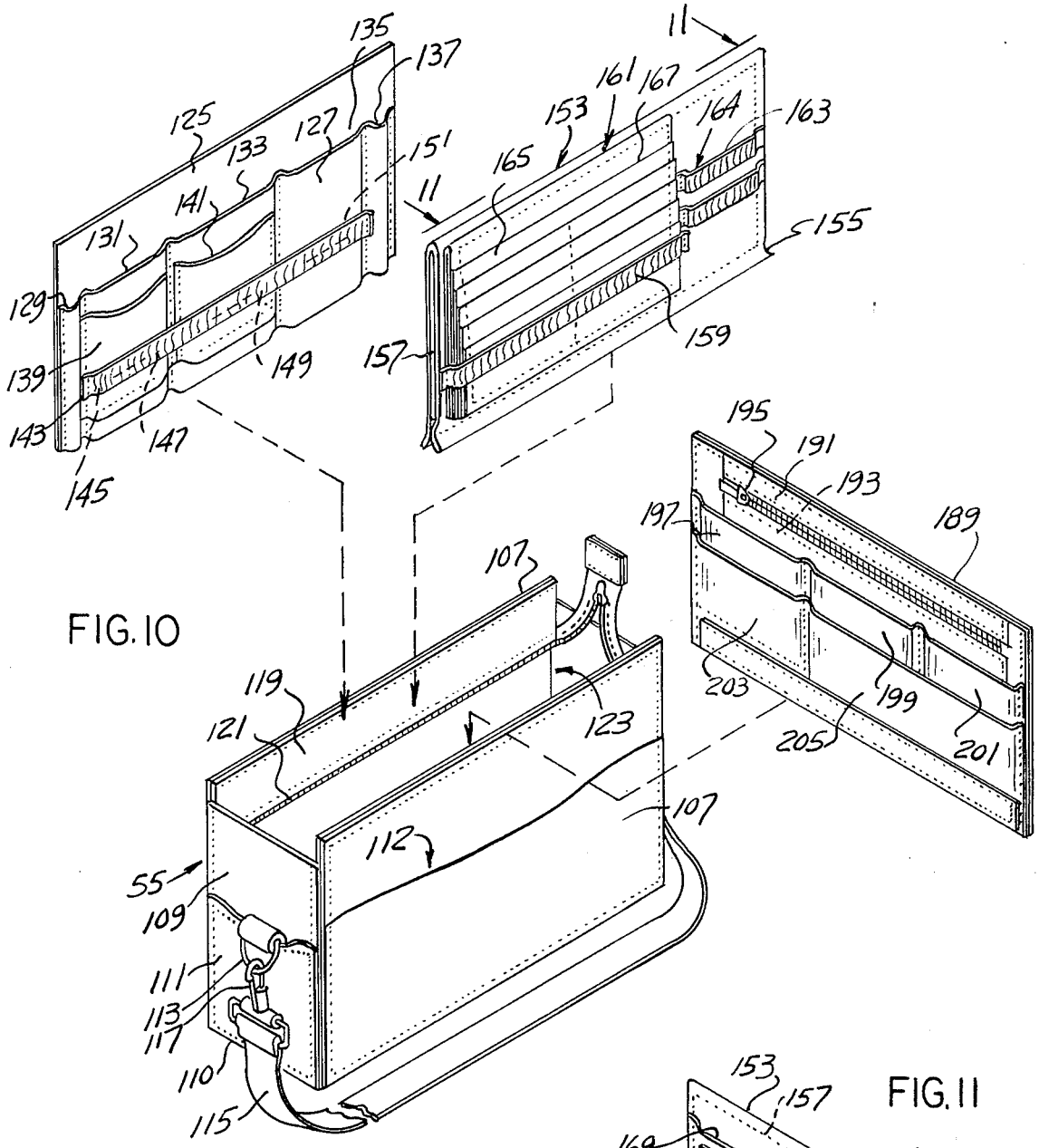
FIG. 10 is a front perspective view of the present clutch bag, with the divider and the front and rear wall inserts shown in exploded view for a clearer understanding of the construction and arrangement of pockets upon the interior of the clutch bag.
Figure 11:
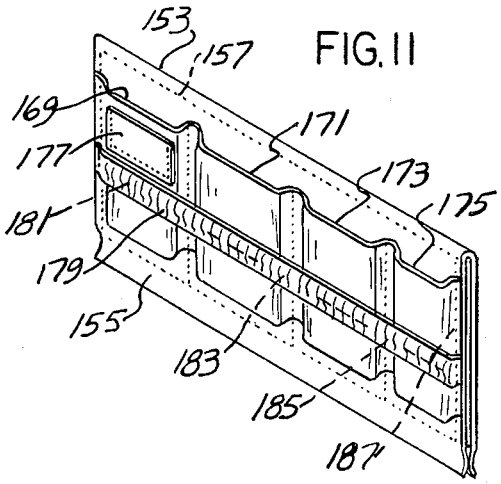
FIG. 11 is a perspective view taken in the direction of arrows 11—11 with respect to the divider of FIG. 10.

Upright divider 79 of a double wall construction incorporates between said walls a cardboard stiffener 81 defining chamber 83 adapted to receive and enclose the clutch bag 55, FIG. 4, shown in detail in FIGS. 10 and 11. Said partition defines an additional storage compartment 85, FIG. 8.

Arranged upon the interior of rear wall of the clutch bag are a series of pockets 89, 91 and 93 defined by the continuous strip 95 secured at spaced points to said interior side wall.

Figure 9:
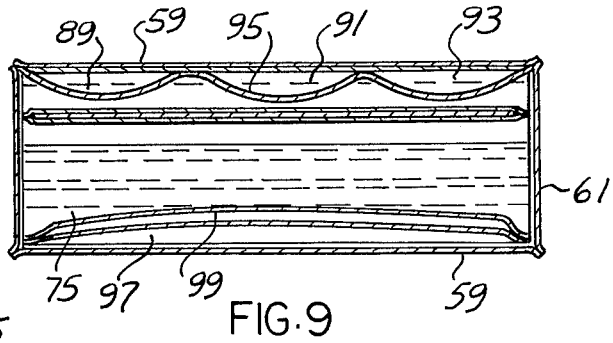
FIG. 9 is a plan section taken in the direction of arrows 9—9 of FIG. 5.

As best shown in FIG. 9, positioned within the chamber 83 and adjacent the opposing wall 59 are a pair of elongated parallel storage pockets 97 and 99. An elongated tube 101 of flexible material is positioned within the auxiliary chamber 87 and secured to the undersurface of the liner bottom wall 75 to define an umbrella storage chamber.

The corresponding end wall 61 of the tote bag is vertically slit for a portion thereof to provide access to the interior of the umbrella storage tube 101. The slit portions are closed by the zipper 103. The bottom wall 20 of the carry-on bag, as in FIGS. 1, 2 and 3, as well as the bottom wall 62 of the tote bag are provided with a series of protective brass studs 22.

The front wall of the tote bag adjacent the storage compartment 87 has a longitudinally slit portion to provide access thereinto. Said slit portion is closed by the double zipper 105.

Within the chamber 83 of the clutch bag 53, there is removably stored the clutch bag 55, shown in FIGS. 4, 10 and 22, in exploded view.

CLUTCH BAG

Referring to FIGS. 10 and 11, the present clutch bag 55 includes side walls 107, end walls 109, bottom wall 110, and a pair of opposed top closure flaps 119 with zipper 121. A pair of loops 113 are secured to the corresponding end walls and are adapted to removably receive the shoulder strap 115, which has at its ends the snap clips 117. Thus, the shoulder strap may be easily changed from the clutch bag 55 to tote bag 53, FIGS. 6 and 7. Glove pocket 112 is provided upon front wall 107.

Arranged within the chamber 123 defined by the walls of the clutch bag are a series of storage pocket areas which thus form a vital and important part of the complete luggage assembly, shown in exploded view, FIGS. 10 and 11. Positioned adjacent one wall of the clutch bag is a backing 125 which may be secured thereto and inwardly thereof an elongated strip 127 which is secured by a series of vertical stitches to the backing 125 to define a series of storage pockets 129, 131, 133, 135 and 137.

Outwardly of the pockets 131 and 133 are an additional pair of storage pockets 139 and 141. The longitudinally extending elastic strip 143 is anchored to the outer pocket 139 at one end at its other end to pocket 137 and secured intermediate its ends as shown by the dash lines to define the additional narrow storage chambers 147, 149, and 151.

The double wall divider 153 shown in exploded view, FIG. 10, is adapted to be mounted upon the interior of the clutch bag 55 intermediate its side walls with its mounting flange 155 bearing against and suitably secured to the bottom wall of the clutch bag. For stiffening purposes, there is provided between said double walls the elongated cardboard insert 157.

Elongated elastic strap 159 is secured at its ends to portions of the divider to provide a pocket on one side thereof adapted to receive and support and secure the flat wallet 161. Additional vertically spaced elastic straps 163 are secured to a portion of the divider wall beyond the elastic strip 159 to provide the additional storage pocket 164. Said wallet has a series of overlapping flaps 165, of decreasing height to define for said wallet a series of elongated storage pockets 167.

FIG. 11 is a view taken in the direction of arrows 11—11 of the divider shown in FIG. 10 in the exploded view, corresponding to the opposite side not shown in FIG. 10. Arranged in a row along said opposite side of the divider are a series of upwardly opening storage pockets 169, 171, 173, and 175.

An elongated elastic strip 179 is secured at a series of points along its length to the respective pockets 169, 171, 173 and 175 to provide an additional series of upright storage pockets 181, 183, 185 and 187.

Adjacent the other side wall of the clutch bag of FIG. 10, and as shown in exploded view, is provided and secured the backing 189 which has thereover a cover 191 to provide a valuables storage compartment 193 with access thereto by the zipper 195. Forwardly of the cover 191 are arranged a series of upright storage pockets 197, 199 and 201. Auxiliary storage pockets are arranged forwardly of the last-mentioned pockets as at 203 and 205.

COCOON (PURSE)

There is also shown in FIG. 12, which may be used with the present assembly or as a separate item if desired, the cocoon 57 also shown in FIG. 4. Said cocoon has a purse-like body 207 which could be made of any suitable material and any desired color or texture to be used as an evening bag. Said bag includes the storage chamber 209, normally closed by the zipper 211 with suitable anchor taps 208 to facilitate opening and closing.

Within said cocoon is a removable insert 213 partly broken away for illustration. Said insert includes the U-shaped backing 215 and 217 with a base connector 219 of flexible material.

A cover 221 is secured peripherally to the backing 215 to define a valuables storage compartment 223 normally closed by the zipper 225. An elastic strip 227 is anchored at its ends to portions of the backing inner surface to define a storage pocket 229 for those valuable desired to be transferred from the clutch bag.

Upon the other backing 217, are arranged an additional series of upright storage pockets 231, 233, and 235. An elastic strip 237 is suitably anchored to the interior surface of the liner 217 to provide the additional storage pocket 239.

The cocoon may be stored within the clutch bag 55 as shown in FIG. 4, or could be stored within the tote bag 53 or, could be stored within the carry-on bag 13 if desired. The cocoon is an auxiliary attachment which may or may not be used but which, if used, provides additional convenience to the traveler in providing a safe storage area for those valuables of the traveler which must accompany the traveler when leaving a hotel room.

Set out hereunder is a list of the respective storage pockets and chambers described and a suggested article which could be conveniently stored therein, merely by way of illustration of the multiple usages that can be provided for the overall comfort of the traveler. The series of bags are used in the overall sense, cooperating together to provide over all convenience for the traveler. For travel the bags 53, 55 and 57 are completely contained within the carry-on bag 13.

of the most important papers and possessions of the traveler.

The cocoon 57, FIGS. 4 and 12, can be used as an evening bag. Its outer cover may be in any color, fabric or texture. Its purpose is to round out the needs of the woman traveler. Some occasions call for a small bag. The outer shell may be very dressy. The fabric could be of silk, satin or even beaded. The varieties are endless. The bag could be very casual. It could be done in denim, patent or suade. Its relationship to the whole assembly is that the removable inner liner 215–217, FIG. 12, is scaled to hold any of the fittings from the clutch bag 55.

The outer shell of the cocoon has a zippered top at 211 with tabs 208 to assist in opening. The inner liner 215–217 is removable and is made of the same fabric as the lining of the clutch bag 55.

The respective opposite ends of the tote bag 53 and clutch bag 55 have loops or rings 69 adapted to removably receive selectively the shoulder strap 115 which is adjustable as to length.

The clutch bag 55 forms a part of the whole unit assembly such as shown in FIG. 4. It could be manufactured, for instance, in black, white, navy, red and so forth and made up of suitable fabrics.

POCKETS AND CHAMBERS

| | |
|---|---|
| 13 CARRY-ON BAG | |
| 35 stores tote bag 53 | 41 shoes, etc. |
| 39 sweater | 31 shelf for shirt, etc. |
| 43 change of lingerie, toiletries | 44 sundry items |
| 53 TOTE BAG | |
| 71 map - newspaper | 89 book |
| 91 camera | 93 sunglasses |
| 97 mail | 99 mail |
| 77 shelf - shirt | 101 umbrella |
| 83 stores clutch bag 55 | |
| 55 CLUTCH BAG | |
| 111 misc. | 112 gloves |
| 131 mirror | 133 tissues - hankerchief |
| 135 notebook | 137 pen - pencil |
| 139 miscellaneous | 141 miscellaneous |
| 145 nailfile | 147 lipstick |
| 149 eye shadow | 151 make up |
| 193 travel tickets - passport checks, money | 197 I.D. |
| 199 I.D. | 201 snapshots |
| 203 datebook | 205 checkbook & address book |
| 153 DIVIDER | |
| 169 cigarettes | 171 glass case |
| 173 key case | 175 comb - brush |
| 177 matches | 181 tubes of lipstick |
| 183 etc. | 185 etc. |
| 187 etc. | 164 change purse |
| 159 wallet | 123 (bottom) jewelry case - pill case |
| 57 COCOON | |
| 209 for liner 213 | 233 pocket |
| 235 pocket | 239 elastic pocket |
| 223 zippered pocket | 227 elastic pocket. |

The present combination carry-on luggage is an all-encompassing piece of hand luggage for women, primarily, but for men also. The carry-on 13, FIG. 1, is the outer bag. It contains the tote bag 53 in the upper chamber and has a storage compartment 43 at the bottom with access thereto by double zipper 47.

The present tote bag 53 is the equivalent of a woman's travel purse. It is arranged so that its fittings have easy accessability. The zippered bottom pouch 43 acts as a catch-all. It has an upper compartment 35 within which is stored the clutch bag 55. The clutch is a smaller purse which lifts out of the tote. It contains all Within the bottom of the chamber 123 of the clutch bag, there is provision for receiving a flexible fabric container for jewelry and a pill case.

The foregoing combination carry-on luggage bag, tote and clutch is adapted to serve the overall needs of the traveler for increasing his comfort and convenience. Thus, there is a cooperation between the carry-on bag, since it mounts and encloses the tote bag 55 which, in turn, mounts and encloses the clutch bag 55. The cocoon 57 may be selectively stored within the clutch bag or the tote bag as desired. It is the cooperation between the usages available between the respective bags which contributes to the overall comfort and convenience to the traveler. The arrangement of bags and their assembly as a unit provides convenient means for storing the miscellaneous articles within the various storage compartments and chambers and pockets. It serves as an overall storage of the most important items used and required by average travelers and, particularly, women though not limited thereto.

Having described my invention, reference should now be had to the following claims.

I claim

1. A carry-on luggage bag comprising a housing having side, end, bottom and top walls;

a liner spanning the side walls with its bottom wall spaced above said bottom wall, defining a first auxiliary storage chamber with a lateral zippered access thereto in one side wall;

an upright divider upon said liner defining a first storage chamber on one side thereof;

a tote bag nested and enclosed in said first storage chamber;

said tote bag including a housing having side, end, top and bottom walls;

an elongated liner mounted on and spanning the latter side walls and spaced above the tote bag bottom wall, defining a second auxiliary chamber with a lateral zippered access thereto in one side wall;

an umbrella storage tube in said second auxiliary chamber, with zippered access thereto in one end wall of the tote bag;

an upright divider upon the tote bag liner, defining a second storage chamber;

a clutch bag nested and enclosed within said second storage chamber;

said clutch bag comprising a housing having side, end, top and bottom walls;

an upright divider upon the bottom wall of the clutch bag extending to the top wall thereof;

a first series of article-storage pockets upon and along the inner surface of the clutch bag one side wall;

a second series of article-storage pockets upon and along the innersurface of the clutch bag other side wall;

and third and fourth series of article-storage pockets upon opposite sides of said clutch bag divider.

2. A carry-on luggage bag comprising a housing of flexible material including side, end and bottom walls and top closure flaps;

a zipper on and interconnecting the meeting edges of said flaps;

an elongated liner mounted upon and spanning the side walls, with the bottom wall of the liner spaced from the housing bottom wall, defining an auxiliary storage chamber;

one side wall being cut away adjacent said auxiliary chamber defining a side flap;

a zipper on and interconnecting the edges of said flap and side wall for access to said auxiliary chamber;

an upright divider mounted upon the liner extending towards said closure flaps defining a first storage chamber on one side thereof, adapted to receive, store and enclose a tote bag, and a second storage chamber upon its other side;

a tote bag nested within said first storage chamber;

said tote bag including a housing of flexible material having side, end and bottom walls, top closure flaps and a zipper interconnecting said flaps;

an elongated liner mounted upon and spanning the latter side walls, with the bottom of the liner spaced from the tote bag bottom wall, defining an auxiliary storage chamber;

one side wall of the tote bag being longitudinally slit adjacent the latter storage chamber;

a zipper along said slit for access to said latter auxiliary chamber;

an upright divider mounted upon the tote bag liner extending substantially to the tote bag closure flaps, defining a first storage chamber on one side thereof adapted to receive and store and enclose an article storage clutch bag;

a second storage chamber upon its other side;

a series of spaced upright article storage pockets within said latter second storage chamber upon and along the interior of the tote bag one side wall;

a pair of parallel elongated upright storage pockets within said tote bag first storage chamber, extending along the length of and upon the interior of the tote bag other side wall;

an article storage clutch bag removably nested and enclosed within said tote bag first storage chamber;

there being a storage chamber in said clutch bag;

a cocoon-like purse assembly enclosed in said carry on bag;

said purse assembly comprising an elongated housing having side, end, top and bottom walls, defining a chamber;

a zippered closure for the top wall thereof;

a removable liner nested in said latter chamber, said liner being of U shape including a pair of upright backings;

a zippered compartment on one backing;

an elastic strap overlying said zippered compartment and at its ends secured thereto, defining a storage pocket;

a plurality of laterally spaced pockets upon the other backing;

and an elastic strip overlying said latter pockets and at its ends secured thereto defining an additional storage pocket.

3. A carry-on luggage bag comprising a housing of flexible material including side, end and bottom walls and top closure flaps;

a zipper on and interconnecting the meeting edges of said flaps;

an elongated liner mounted upon and spanning the side walls, with the bottom wall of the liner spaced from the housing bottom wall, defining an auxiliary storage chamber;

one side wall being cut away adjacent said auxiliary chamber defining a side flap;

a zipper on and interconnecting the edges of said flap and side wall for access to said auxiliary chamber;

an upright divider mounted upon the liner extending towards said closure flaps defining a first storage chamber on one side thereof, adapted to receive, store and enclose a tote bag, and a second storage chamber upon its other side;

a tote bag nested within said first storage chamber;

said tote bag including ahousing of flexible material having side, end and bottom walls, top closure flaps and a zipper interconnecting said flaps;

an elongated liner mounted upon and spanning the latter side walls, with the bottom of the liner spaced from the tote bag bottom wall, defining an auxiliary storage chamber;

one side wall of the tote bag being longitudinally slit adjacent the latter storage chamber;

a zipper along said slit for access to said latter auxiliary chamber;

an umbrella storage tube of flexible material suspended within said tote bag auxiliary chamber throughout its length;

one tote bag end wall having a slit portion for the height of said tube;

and a zipper interconnecting said slit portions for access to said tube.

4. A carry-on luggage bag comprising a housing of flexible material including side, end and bottom walls and top closure flaps;

a zipper on and interconnecting the meeting edges of said flaps;

an elongated liner mounted upon and spanning the side walls, with the bottom wall of the liner spaced from the housing bottom wall, defining an auxiliary storage chamber;

one side wall being cut away adjacent said auxiliary chamber defining a side flap;

a zipper on and interconnecting the edges of said flap and side wall for access to said auxiliary chamber;

an upright divider mounted upon the liner extending towards said closure flaps defining a first storage chamber on one side thereof, adapted to receive, store and enclose a tote bag, and a second storage chamber upon its other side;

a pair of parallel spaced longitudinally extending elastic straps within said auxiliary chamber at their ends secured to the under surface of said liner bottom wall at its ends, defining with said liner bottom wall when stretched downwardly an article support and storage area adjacent said liner bottom wall.

5. In the carry-on luggage bag of claim 4 an elastic strap extending around and secured at a series of spaced points to the interior walls defining said auxiliary chamber intermediate its top and bottom, to provide with said walls a series of article storage pockets therein.

6. A carry-on luggage bag comprising a housing of flexible material including side, end and bottom walls and top closure flaps;

a zipper on and interconnecting the meeting edges of said flaps;

an elongated liner mounted upon and spanning the side walls, with the bottom wall of the liner spaced from the housing bottom wall, defining an auxiliary storage chamber;

one side wall being cut away adjacent said auxiliary chamber defining a side flap;

a zipper on and interconnecting the edges of said flap and side wall for access to said auxiliary chamber;

an upright divider mounted upon the liner extending towards said closure flaps defining a first storage chamber on one side thereof, adapted to receive, store and enclose a tote bag, and a second storage chamber upon its other side;

a tote bag nested within said first storage chamber;

said tote bag including a housing of flexible material having side, end and bottom walls, top closure flaps and a zipper interconnecting said flaps;

an elongated liner mounted upon and spanning the latter side walls, with the bottom of the liner spaced from the tote bag bottom wall, defining an auxiliary storage chamber;

one side wall of the tote bag being longitudinally slit adjacent the latter storage chamber;

a zipper along said slit for access to said latter auxiliary chamber;

and a pair of longitudinally extending elastic straps within the auxiliary chamber of the tote bag secured at their ends to the under surface of the tote bag liner bottom wall at its ends, defining with said liner bottom wall an article support and storage area adjacent said liner bottom wall.

7. A carry-on luggage bag comprising a housing of flexible material including side, end and bottom walls and top closure flaps;

a zipper on and interconnecting the meeting edges of said flaps;

an elongated liner mounted upon and spanning the side walls, with the bottom wall of the liner spaced from the housing bottom wall, defining an auxiliary storage chamber;

one side wall being cut away adjacent said auxiliary chamber defining a side flap;

a zipper on and interconnecting the edges of said flap and side wall for access to said auxiliary chamber;

an upright divider mounted upon the liner extending towards said closure flaps defining a first storage chamber on one side thereof, adapted to receive, store and enclose a tote bag, and a second storage chamber upon its other side;

a tote bag nested within said first storage chamber;

said tote bag including a housing of flexible material having side, end and bottom walls, top closure flaps and a zipper interconnecting said flaps;

an elongated liner mounted upon and spanning the latter side walls, with the bottom of the liner spaced from the tote bag bottom wall, defining an auxiliary storage chamber;

one side wall of the tote bag being longitudinally slit adjacent the latter storage chamber;

a zipper along said slit for access to said latter auxiliary chamber;

an upright divier mounted upon the tote bag liner extending substantially to the tote bag closure flaps, defining a first storage chamber on one side thereof adapted to receive and store and enclose an article storage clutch bag;

a second storage chamber upon its other side;

a series of spaced upright article storage pockets within said latter second storage chamber upon and along the interior of the tote bag one side wall;

a pair of parallel elongated upright storage pockets within said tote bag first storage chamber, extending along the length of and upon the interior of the tote bag other side wall;

an article storage clutch bag removably nested and enclosed within said tote bag first storage chamber;

said clutch bag including a housing of flexible material having side, end and bottom walls, top closure flaps and a zipper on and interconnecting the meeting edges of said flaps;

an upright divider upon the bottom wall of said clutch bag extending to said flaps.

a first series of article storage pockets upon and along the inner surface of the clutch bag one side wall;

a second series of article storage pockets upon and along the inner surface of the clutch bag other side wall;

and a third and fourth series of article storage pockets upon opposite sides of said latter divider.

8. In the luggage bag of claim 7, said first and second series of storage pockets including an upright backing in registry with and connected to the respective interiors of said clutch bag side walls; a cover sheet juxtaposed over one of said backings and peripherally secured thereto, defining an elongated valuables storage pocket; said cover sheet having a longitudinally slit portion adjacent its top for access to said valuables storage pocket; and a zipper closing said slit portions.

9. In the luggage bag of claim 7, said third series of pockets adapted to removably store an elongated flat wallet; said wallet including a plurality of outwardly stacked pockets of progressively decreasing height to provide convenient access to all wallet pockets.

10. In the luggage bag of claim 7, pairs of rings pivotally mounted upon the end walls of said tote bag and clutch bag; and a simple adjustable shoulder strap with snap clips on its ends selectively connected to a corresponding pair of said rings.

11. A bag comprising a housing of flexible material including side, end and bottom walls and top closure flaps;

a zipper on and interconnecting the meeting edges of said flaps;

an elongated liner mounted upon and spanning the side walls with the liner spaced from the housing bottom wall, defining an auxiliary storage chamber;

one side wall being cut away adjacent said auxiliary chamber defining a side flap;

a zipper on and interconnecting the edges of said flap and side wall for access to said auxiliary chamber;

an upright divider mounted upon the liner extending towards said closure flaps defining a first storage chamber on one side thereof, adapted to receive, store and enclose a second bag, and a second storage chamber upon its other side;

a second bag nested within said first chamber;

an umbrella storage tube of flexible material suspended within said auxiliary chamber throughout its length;

one end wall of said luggage bag having a slit portion for the height of said tube;

and a zipper interconnecting said slit portions for access to said tube.

* * * * *